United States Patent [19]

Weidmann

[11] 4,421,143

[45] Dec. 20, 1983

[54] INDUCTIVE PROJECTILE SENSOR ON A GRIPPER SHUTTLE WEAVING MACHINE

[75] Inventor: Erich Weidmann, Wetzikon, Switzerland

[73] Assignee: Loepfe Brothers Limited, Wetzikon, Switzerland

[21] Appl. No.: 327,560

[22] Filed: Dec. 4, 1981

[30] Foreign Application Priority Data

Dec. 13, 1980 [CH] Switzerland ..... 9189/80

[51] Int. Cl.[3] ..... D03D 51/40

[52] U.S. Cl. ..... 139/341; 139/370.2

[58] Field of Search ..... 139/341, 342, 336, 370.1, 139/370.2

[56] References Cited

U.S. PATENT DOCUMENTS 3,326,246 6/1967 Gurney ..... 139/341

4,250,931 2/1981 Zeleny ..... 139/341

FOREIGN PATENT DOCUMENTS 47-13465 4/1972 Japan ..... 139/370.2

469839 4/1969 Switzerland ..... 139/341

*Primary Examiner*—Henry Jaudon

*Attorney, Agent, or Firm*—Werner W. Kleeman

[57] ABSTRACT

Electronic control device on a gripper shuttle or projectile weaving machine or loom containing a lathe beam and thereto fixed teeth for guiding the gripper shuttle or projectile which inserts the weft or filling thread into the weaving shed, and a thread brake located at the picking side of the loom. The electronic control device comprises a sensor arranged on the lathe beam at least at one of the guide teeth and which furnishes an electrical sensor signal when the projectile passes by, an evaluation circuit connected to the sensor, and an electromagnetic device operatively connected to the evaluation circuit such as to actuate the thread brake upon appearance of an electrical sensor signal.

5 Claims, 5 Drawing Figures

INDUCTIVE PROJECTILE SENSOR ON A GRIPPER SHUTTLE WEAVING MACHINE

CROSS REFERENCE TO RELATED APPLICATION

This application is related to the commonly assigned copending United States application Ser. No. 06/327,559, filed Dec. 4, 1981, entitled "Inductive Projectile Sensor on a Gripper Shuttle Weaving Machine".

BACKGROUND OF THE INVENTION

The present invention relates to a new and improved electronic control device on a gripper shuttle weaving machine or loom which is of the type comprising a lathe beam and thereto fixed teeth for guiding the stripper shuttle which inserts the weft thread or filling into the weaving shed, and a thread brake located at the picking side of the weaving machine.

Swiss Pat. No. 469,839 discloses a procedure for operating a gripper shuttle weaving machine, wherein a weft thread brake is released or disabled during the throw of the shuttle and enabled or actuated when the shuttle reaches the catch box. For this purpose, a shuttle sensor is provided in the catch box for actuating the thread brake through an electronic control and amplifier device and an electromagnet.

With this known procedure and arrangement, the thread brake cannot be actuated speedily enough when the shuttle is braked and slowed down in the catch box. As a consequence thereof, the weft or filling thread may overshoot in the weaving shed such that faulty selvedges or loose weft threads cannot be avoided with certainty.

SUMMARY OF THE INVENTION

Therefore, it is a primary object of the invention to provide a new and improved control device for an electronic gripper shuttle weaving machine which avoids the aforementioned deficiencies and shortcomings.

It is a more specific object of the invention to provide a control device which enables rapidly actuating the thread brake and thus avoids formation of faulty filling or weft insertions and defective selvedges.

These objects and others which will become more readily apparent as the description proceeds are implemented by the electronic control device of this invention which comprises a sensor arranged at least at one of the guide teeth for furnishing an electrical sensor signal indicative of the passage of the gripper shuttle; an evaluation circuit connected to the sensor; and an electromagnetic device operatively connected to the evaluation circuit for actuating the thread bake upon appearance of an electrical sensor signal.

BRIEF DESCRIPTION OF THE DRAWING

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
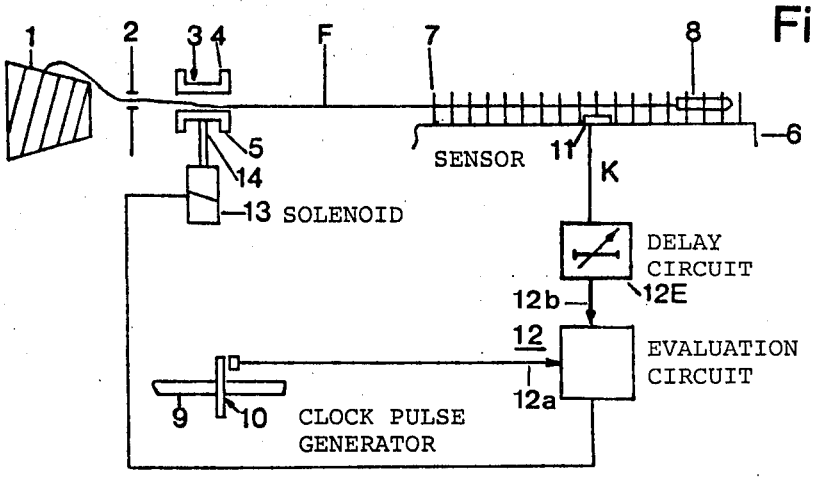
FIG. 1 is a schematic representation of a preferred embodiment of the inventive electronic control device, and some therewith co-operating components of a gripper shuttle or projectile weaving machine.

With reference to FIG. 1, there are shown the following components of the gripper shuttle weaving machine or loom: a supply spool 1, a yarn guide 2, a yarn brake 3 having a fixed jaw 4 and a movable jaw 5, part of the lathe beam 6 with guide teeth 7, a projectile or gripper shuttle 8 in a position just before the end of the lathe beam 6, and part of the main drive shaft 9. The electronic control device 10–14 comprises a conventional clock pulse generator 10, a projectile sensor, in brief referred to sometimes herein simply as sensor 11, an electronic evaluation circuit 12 having two inputs, an adjustable delay circuit 12E, and an actuation device comprising a magnet coil or solenoid 13 and an armature 14 which is mechanically connected to the movable jaw 5 of the yarn brake 3.

The first input 12*a* of the evaluation circuit 12 is connected to the clock pulse generator 10, whereas the second input 12*b* thereof is connected with the sensor 11 through the delay circuit 12E. The evaluation circuit 12 may comprise a bistable circuit having set and reset inputs, such as to be set by the output of the clock pulse generator 10 connected to the set input, and reset by the output of the delay circuit 12E connected to the reset input. The delay circuit 12E may comprise a monostable circuit or monoflop which shapes a signal from the sensor 11 into a rectangular pulse whose length can be adjusted.

The gripper shuttle weaving machine may be of conventional construction as shown, by way of example, in the above-mentioned Swiss Pat. No. 469,839.

Figure 2:
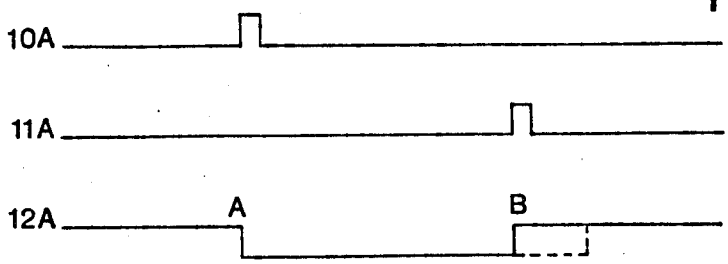
FIG. 2 is a pulse diagram illustrating the operation of the control device represented in FIG. 1.

FIG. 2 schematically illustrates some signals produced by the control device 10–14 with the operating weaving machine during the weft or filling insertion: the output signal or clock pulse 10A of the clock pulse generator 10, the output signal or sensor signal 11A of the sensor 11, and the output signal or braking signal 12A of the evaluation circuit 12.

The clock pulse generator 10 which is coupled to the main drive shaft 9 of the weaving machine furnishes a start or clock pulse 10A with every revolution of the main drive shaft 9. The clock or start pulse 10A interrupts the braking signal 12A at the instant A such as to release the up to this instant closed yarn brake 3. At the same time, the projectile 8 is shot off, and the weft thread guided by the guide teeth 7 is inserted into the weaving shed. When the projectile passes by the sensor 11, the latter produces a sensor signal 11A which causes the braking signal 12A to reverse and close or actuate the yarn brake 3 again at the instant B.

The clock or start pulse 10A corresponds to an angular position of the main drive shaft 9 of e.g. 100 degrees. A very accurate adjustment of this angle is possible by a clock pulse generator 10 which comprises an exactly graduated circular scale.

The adjustable delay circuit 12E makes it possible to delay the sensor signal 11A, and thus the instant B of the braking signal 12, by a time interval which is adjustable within certain limits as illustrated by the dashed line.

Thus, the instant of actuation of the thread brake 3 may be accommodated to various operational conditions of the weaving machine, thus avoiding any mechanical adjustment or displacement of the sensor 11.

The time-delay circuit 12E may be lodged in a portable housing or case provided with a plug connection or connector. Thus, it is possible for an operator to adjust the instant B and to simultaneously watch the selvedge. Such a procedure is not possible with the presently known control devices.

Figure 3:
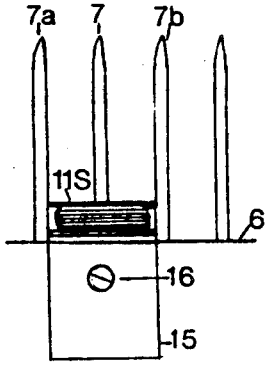
FIGS. 3, 4 and 5 respectively illustrate the arrangement of an inductive projectile sensor attached to one of the guide teeth of the weaving machine, viewed from the front side of the machine, in end view and plan view.
Figure 4:
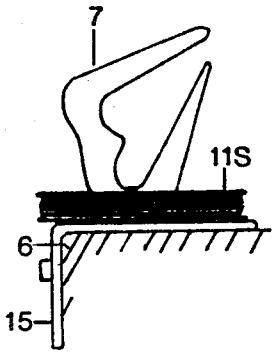
Figure 5:
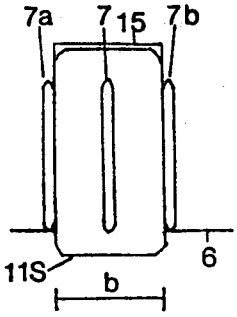

Referring to FIGS. 3, 4 and 5, an inductive sensor 11S comprising an induction coil is fixed to the lathe beam 6 by means of a coil support 15 and screw 16 or equivalent structure.

The substantially rectangular shape of the inductive sensor 11S, FIG. 5, is accommodated to the cross-section of the guide tooth 7 and to the distance to the thereto adjacent guide teeth *7a*,*7b*. Thus, the inductive sensor 11S can be set onto the guide tooth 7 from the top thereof without removing the same from the lathe beam 6.

In order to provide for a strong magnetic field a D.C.-current may be applied to the induction coil of the inductive sensor 11S. When the projectile 8 passes by, a D.C.-pulse occurs in the induction coil, the amplitude of which is substantially greater than that of the always present spurious or noise signals, so that there is ensured for positive actuation of the yarn brake 3. As shown in FIG. 1, the sensor 11S is connected, through a connection line K not depicted in the FIGS. 3, 4 and 5, to the delay circuit 12E. The connection line K is preferably fixed to or along the pivotal shaft of the lathe in order to minimize transfer of torque to the connection line K.

The width b of the inductive sensor 11S in the direction of the lathe beam 6, FIG. 5, is dimensioned such that the inductive sensor 11S can be placed between two guide teeth *7a*,*7b* neighbouring the guide tooth 7.

The inventive control device is not limited to the use of inductive sensors: in place thereof there might be used an optoelectrical sensor based on the light reflection principle, and which transmits a light beam which is reflected from the passing projectile 8. However, an inductive sensor 11S of the above-described type is advantageous insofar as it is insensitive to dust and dirt.

The coil of the inductive sensor 11S depicted in FIGS. 3, 4 and 5 also may surround two of the guide teeth 7; however, the illustrated embodiment of the inductive sensor 11S which surrounds one guide tooth is the simplest embodiment.

The illustrated and above-described control device may be used on a one color as well as on a multicolor weaving machine. Since the last-mentioned types of machines comprise a multiplicity of yarn brakes, there must be provided a change-over switch between the evaluation circuit 12 and the various magnetic actuation devices, such as the device 13,14 in FIG. 1, which change-over switch is controlled by a color change mechanism.

The above-described control device has various advantages over the conventional yarn brake controls which are mechanically synchronized with the main drive shaft of the weaving machine. Some of such advantages will be mentioned in the following portion of the description.

The mechanically controlled yarn brake is actuated—independent of the speed of the projectile—in a definite instant or with a definite angular position of the main drive shaft, e.g. 260°. Now when the projectile is too fast, as in the case of a very thin weft thread, the braking action occurs too late and along a relatively short braking or stop distance, and thus is insufficient. However, with the yarn brake of the present invention which is controlled by the projectile flight, when the projectile is too fast and arrives too early at the sensor, the braking action automatically starts at an instant earlier than otherwise would occur with normal speed, and the stop distance is not reduced.

Moreover, the projectile-controlled braking procedure of the invention is independent of the rotational speed of the main drive shaft and the angular position thereof. Thus, when the weaving machine is manually driven for test purposes, the adjustment of the yarn brake can be monitored at any individual weft or filling. This is impossible with the mechanically controlled yarn brake since there the start of the braking occurs only when the mentioned angular position is reached, i.e. when the weft thread has already been inserted into the weaving shed.

While there is shown and described a present preferred embodiment of the invention, it is to be distinctly understood that the invention is not limited thereto, but may be otherwise variously embodied and practiced within the scope of the following claims. Accordingly,

What I claim is:

1. An electronic control device for a gripper shuttle weaving machine containing a lathe beam and thereto fixed guide teeth for guiding the gripper shuttle which inserts the weft thread into the weaving shed, and a thread brake located at the picking side of the weaving machine, wherein the electronic control device comprises:

a sensor arranged at least at one of the guide teeth for furnishing an electrical sensor signal indicative of the passage of the gripper shuttle;

an evaluation circuit connected to the sensor;

an adjustable delay circuit operatively interconnected between the sensor and the evaluation circuit for delaying the electrical sensor signal; and an electromagnetic device operatively connected to the evaluation circuit for actuating the thread brake upon appearance of an electrical sensor signal.

2. The electronic control device as claimed in claim 1 wherein:

the sensor is constructed as an inductive sensor comprising an induction coil encircling at least said one guide tooth.

3. The electronic control device as defined in claim 2, wherein:

said inductive sensor including said coil are releasably mounted at said at least one guide tooth to enable said inductive sensor to be shifted and remounted at any other selected one of said guide teeth, in order to accommodate the position of the sensor to the width of a fabric which is woven at the weaving machine.

4. The electronic control device as defined in claim 2, wherein:

said guide tooth piercingly extends through said induction coil and simultaneously serves as a core for the inductive sensor.

5. An electronic control device for a gripper shuttle weaving machine containing a lathe beam and thereto fixed guide teeth for guiding the gripper shuttle which inserts the weft thread into the weaving shed, and a thread brake located at the picking side of the weaving machine, wherein the electronic control device comprises:

a sensor arranged at least at one of the guide teeth for furnishing an electrical sensor signal indicative of the passage of the gripper shuttle;

said sensor being constructed as an inductive sensor comprising an induction coil encircling at least said one guide tooth;

an evaluation circuit connected to the sensor; and an electromagnetic device operatively connected to the evaluation circuit for actuating the thread brake upon appearance of an electrical sensor signal.

* * * * *